United States Patent [19]

Gandini

[11] Patent Number: 5,044,018

[45] Date of Patent: Sep. 3, 1991

[54] TOILET WITH DEVICE FOR REMOVING UNPLEASANT ODORS

[75] Inventor: Luigi Gandini, Cernusco Lombardone, Italy

[73] Assignee: American Standard Inc., New York, N.Y.

[21] Appl. No.: 545,690

[22] Filed: Jun. 29, 1990

Related U.S. Application Data

[63] Continuation of Ser. No. 352,523, May 16, 1989, abandoned.

[30] Foreign Application Priority Data

May 16, 1988 [IT] Italy ..... 46849 A/88

[51] Int. Cl.[5] ..... E03D 9/052

[52] U.S. Cl. ..... 4/216

[58] Field of Search ..... 4/213, 216

[56] References Cited

U.S. PATENT DOCUMENTS

| | | | |
|---|---|---|---|
| 2,058,436 | 10/1936 | Friel | 4/213 |
| 2,329,221 | 9/1943 | Sanford | 4/213 |
| 2,452,282 | 10/1948 | Auer | 4/216 X |
| 3,942,200 | 3/1976 | Pearson | 4/213 X |
| 4,222,129 | 9/1980 | Baker | 4/216 X |

*Primary Examiner*—Charles E. Phillips

*Attorney, Agent, or Firm*—Blum Kaplan

[57] ABSTRACT

A ventilation system for a toilet to remove odors therefrom is disclosed. The ventilation system includes a suction apparatus whose intake is connected to the upper region of the bowl above the water seal, an outlet passage whose opening communicates with the waste discharge passage of said toilet at a point below the water seal, and a valve means mounted in the outlet passage which is normally closed when the suction apparatus is inoperative. The suction apparatus and valve means are electrically operated.

3 Claims, 3 Drawing Sheets

TOILET WITH DEVICE FOR REMOVING UNPLEASANT ODORS

This is a continuation of application Ser. No. 07/352,523, filed on May 16, 1989 now abandoned.

BACKGROUND OF THE DISCLOSURE

1. FIELD OF THE INVENTION

This invention relates to a toilet of the siphon type, capable of drawing away unpleasant odors and conveying them to the corresponding drain.

2. DESCRIPTION OF PRIOR ART

Everyone is familiar with the annoyance and inconvenience caused by the unpleasant odors which occur in rooms equipped with toilets. A toilet having means which uses water flow to create a vacuum to draw off odors is known, see U.S. Pat. No. 8,188,658.

It is also known that the use of deodorants, like the utilization o ventilation fans installed in the relevant rooms, has proven unsuitable and/or inadequate to eliminate said unpleasant odors due to the fact that the latter are allowed to propagate into the surrounding room.

SUMMARY OF THE INVENTION

An object of the invention is to provide a toilet capable of drawing away unpleasant odors before they have time to propagate into the surrounding room.

Another object of the invention is to provide a toilet capable of drawing away unpleasant odors in the region where they are formed, namely, the bowl of the toilet, and simultaneously conveying them to the toilet drain, downstream of the siphon.

According to the invention, the proposed toilet comprises a hollow base, a bowl with associated wall or floor drain, and a closed or open flange to drain flushing water into the bowl, A suction assembly is provided which is housed in the base, the intake opening of which is connected to the toilet bowl through a channel which opens in proximity to at least the posterior section of flange or flush rim, while its delivery opening is connected to the toilet's drain. Also provided are valve means interposed between the delivery end of the suction assembly and the toilet drain, along with means capable of activating or deactivating the suction assembly simultaneously with opening or closing of the valve means.

In addition, according to the invention, the channel through which the odors are drawn away is shaped so as to allow, if necessary, the passage of air countercurrently to the direction of flush water towards the toilet bowl, without causing disadvantageous water suction.

DETAILED DESCRIPTION OF THE PREFERRED EMBODIMENT

Figure 1:
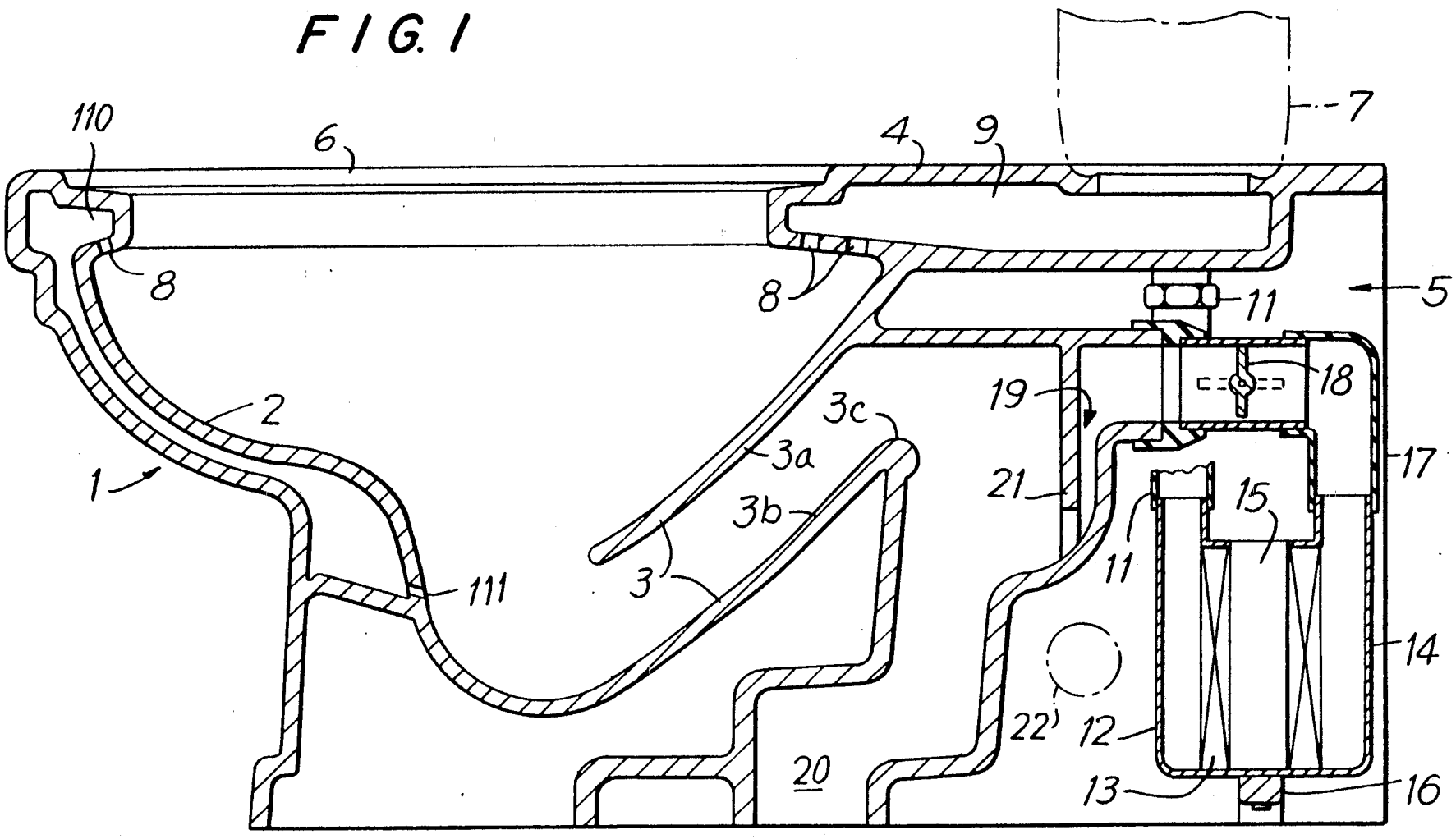
FIG. 1 is an elevational view, in section, of a toilet, according to the invention.

Referring in detail to the drawings, and particularly FIG. 1, is shown toilet 1 having a bowl 2 with its lower end in communication with siphon passageway 3 having an ascending by and a descending by leading to outlet drain or waste opening 20. A flat deck or shelf 4 is formed at the rear upper surface of toilet 1, on which is mounted a flush tank 7 of known design, shown in broken line. A well or housing 6 is provided at the rear portion of toilet i which houses suction apparatus, shown in FIGS. and 2. Flange or flush rim 6, of the closed type, is formed around the top of toilet I, and is provided with a plurality of spaced-apart discharge openings 8. Water discharged from tank 7 passes into water collection chamber 9, which is connected to rim passage 110 of flush rim 6 so that water discharges through openings 8 and through a siphon jet opening 111 to assist the siphon action of toilet 1 after each use.

Figure 4:
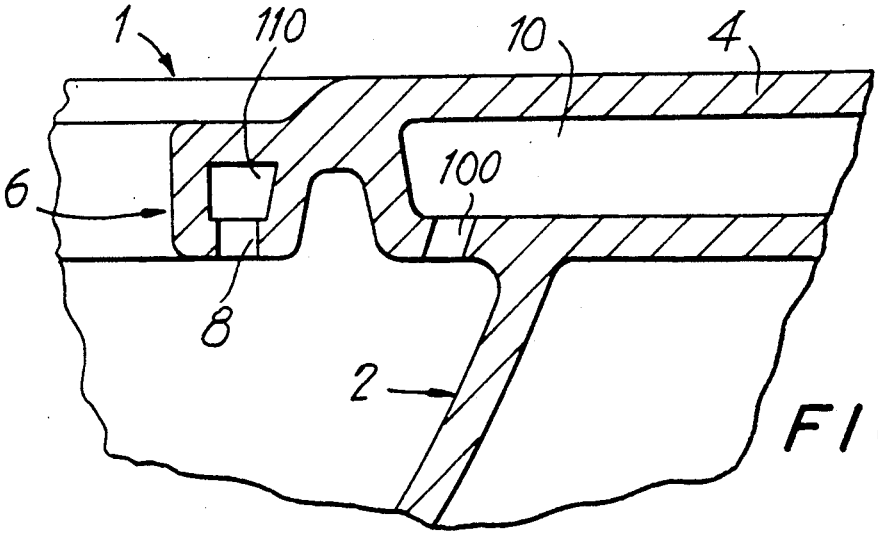
FIG. 4 is a sectional view taken along line IV—IV of FIG. 3.
Figure 3:
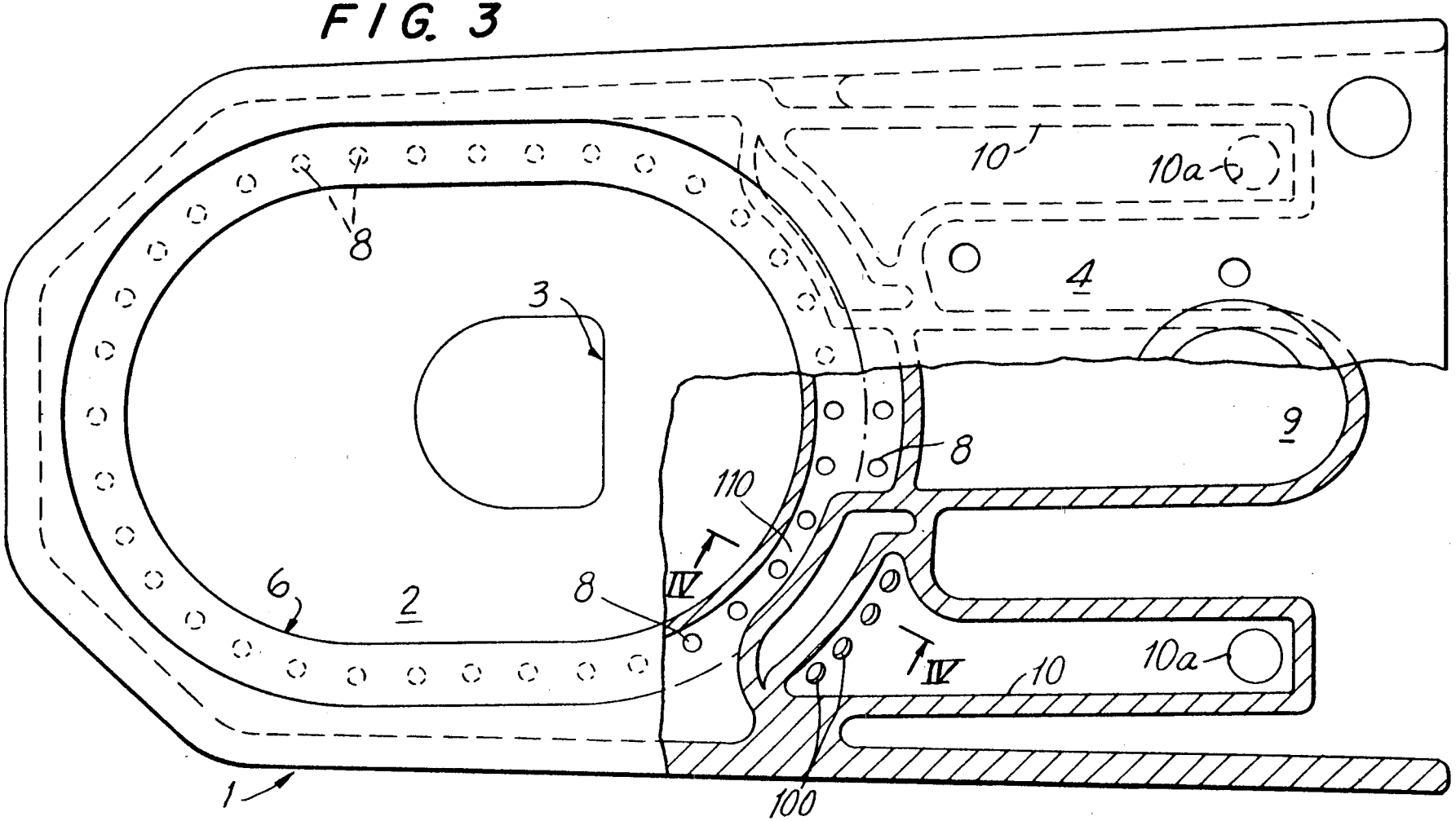
FIG. 3 is a top plan view, partly in section, of the rear portion of the toilet.

Referring to FIGS. 3 and 4, on opposite ends of water collection chamber 9 are two ventilation chambers 10, each provided with a series of openings 100 formed in the rear wall of bowl 2 beneath openings 8 of flush rim 6. In this manner, the front end portion of ventilation chamber 10 communicates with a wider area of bowl 2, and extends over its rear wall above the water level or seal in bowl 2. Also, rim passage 110 of flange 6 provides for direct passage of water to discharge openings 8, while chambers 10 provide openings 100 to draw away unpleasant odors countercurrently to the direction of flush water along the walls of bowl 2, as will become evident below.

Figure 2:
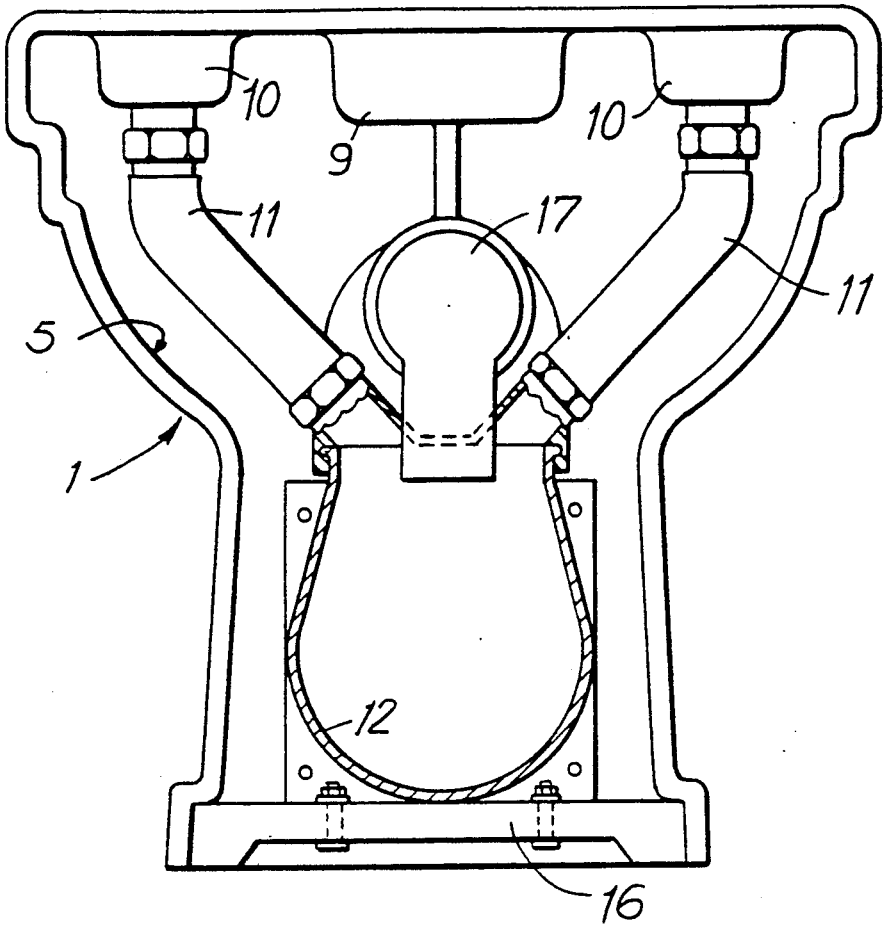
FIG. 2 is a rear elevational view, partly in section, illustrating a portion of the suction assembly.

Openings 10*a* are formed on the bottom wall of chambers 10, to which are connected suction pipes or conduits 11, the other ends of which are coupled to suction collector or apparatus 12, FIG. 2. The other ends of pipes 11 are mounted on the frame of suction rotor 13, which consists of a centrifugal fan, on the opposite part of which is installed a delivery or outlet manifold 14. Rotor 13 and its accessories are mounted in housing 5, see FIG. 1, with rotor 13 mounted on a cross-member 16 which is unitary with toilet 1.

Electric motor 15 is provided to drive rotor 13, and is controlled to start and stop by a suitable switch, not shown. Preferably, motor 15 is controlled by timing means which permits the motor to operate for predetermined periods, for example, a few minutes after each corresponding actuation of the switch.

The suction apparatus in FIGS. 1 and 2 includes manifold 14 and delivery pipe 17 or air discharge passage, which has mounted therein butterfly valve 18. Suction apparatus is connected to ventilation discharge passage 17 at one end, and to siphon 3 through opening 19 at its other end. Opening 19 is formed by a wall or baffle 21 so that air discharge through passage 17 enters the descending leg of siphon passageway 3 before entering drain outlet 20. A butterfly valve 18 is mounted in discharge passage 17, and is shown in its closed position in FIG. 1. Siphon passageway 3 includes an upper wall 3*a* and a lower wall 3*b*. Lower wall 3*b* includes an uppermost portion 3*c* which defines the highest level of the water seal. Partition 2 extends below the highest level of the water seal defined at uppermost portion 3*c* of siphon passageway 3 and, together with butterly valve 18, prevents backflow of water into discharge passage 17. Butterfly valve 18 is connected, by means of a lever mechanism, not shown, to the core of an electromagnet 22, shown in broken lines in FIG. 1. Electromagnet 22 is connected to an electrical circuit supplying power to motor 15 causes when the suction apparatus is operative, butterfly valve is to open, the position shown in broken line in FIG. i, and to close, the position shown in solid lines in FIG. i, simultaneously with the stopping of motor 15.

From the foregoing detailed description of the invention, merits and advantages, like its modes of operation, are clearly understood. While modifications and variations may be made, it should be understood that the invention is not limited to the embodiment shown.

What is claimed:

1. A ventilating system in combination with a toilet having a bowl coupled to an outlet drain through a siphon passageway at the rear of said bowl which forms a water seal when water is in said bowl, the combination comprising a suction apparatus mounted within a housing at the rear section of said toilet proximate said siphon passageway; said siphon passageway having an ascending leg and a descending leg with said ascending leg having an upper wall and a lower wall, said lower wall having an uppermost portion defining the highest level of said water seal, said suction apparatus including at least one conduit connected at one end to the bowl of said toilet above the highest level of said water seal and its other end connected to an air intake opening of an electrically-powered suction device, an air discharge passage connected at a first end to the water discharge passage of said bowl having an air discharge opening at a point below the highest level of said water seal and at its second end to an outlet opening of said suction apparatus; said air discharge passage having at least a portion thereof above the highest level of said water seal; valve means mounted in said air discharge passage at a position above the highest level of said water seal; and said valve means being electrically operable from its closed to its opened positions simultaneously with the starting and stopping of said suction device so that when said suction device is operative, air containing foul odor is drawn from above the water seal and is discharged through the air discharge opening into the waste drain passage of said toilet, said air discharge passage including a partition wall formed integrally with said toilet bowl and disposed at the first end of said air discharge passage, said partition wall extending downwardly across the first end of said air discharge passage in said descending leg from a point above the highest level of said water seal to a position below the highest level of the water seal in said toilet to define said air discharge opening, said partition wall and valve means, when closed, preventing waste water in said waste drain passage from flowing into said suction apparatus.

2. The combination of claim 1 wherein said at least one air intake conduit is a pair of conduits mounted, respectively, to ventilation chambers formed above said housing of said suction apparatus at the rear of said bowl, each of said chambers having a wall forming a part of the bowl of said toilet, each of said walls having a plurality of openings forming said inlet of said ventilation system.

3. The combination, in accordance with claim 1, wherein said valve means is a butterfly valve and including electromagnetic means mechanically coupled to said butterfly valve for opening said butterfly valve when said suction means is operating.

* * * * *